US008215870B2

(12) United States Patent
Palmer

(10) Patent No.: US 8,215,870 B2
(45) Date of Patent: Jul. 10, 2012

(54) SYSTEMS AND METHODS FOR PROTECTING SUBTERRANEAN STRUCTURES

(76) Inventor: Andrew C. Palmer, Singapore (SG)

( * ) Notice: Subject to any disclaimer, the term of this patent is extended or adjusted under 35 U.S.C. 154(b) by 175 days.

(21) Appl. No.: 12/239,586

(22) Filed: Sep. 26, 2008

(65) Prior Publication Data

US 2010/0080656 A1 Apr. 1, 2010

(51) Int. Cl.
*E03B 7/10* (2006.01)

(52) U.S. Cl. ..... 405/157; 405/179

(58) Field of Classification Search ..... 405/157, 405/159, 179, 184.4, 154.1, 50, 15, 18, 107, 405/112, 114, 115, 302.6, 302.7; 138/104, 138/105, 110

See application file for complete search history.

(56) References Cited

U.S. PATENT DOCUMENTS 3,115,861 A * 12/1963 Allen ..... 405/157
4,912,862 A * 4/1990 Bishop et al. ..... 37/142.5
4,919,210 A 4/1990 Schaefer, Jr.
4,940,366 A * 7/1990 Suzuki ..... 405/267
5,099,889 A * 3/1992 Ratzlaff ..... 138/110
5,154,540 A * 10/1992 Barley ..... 405/259.5
5,765,967 A * 6/1998 Klaymar ..... 405/179
5,911,539 A * 6/1999 Egan et al. ..... 405/20
5,988,227 A * 11/1999 Magoffin ..... 138/110
6,514,009 B2 2/2003 Northcott et al.
6,702,518 B2 * 3/2004 Harris ..... 405/157
6,764,250 B2 * 7/2004 Kim et al. ..... 405/157
7,147,402 B2 12/2006 Edfeldt
2002/0187005 A1 * 12/2002 Le Blanc ..... 405/36
2003/0113092 A1 * 6/2003 Porter ..... 385/147
2006/0179730 A1 8/2006 Bittner

OTHER PUBLICATIONS

Palmer, A.C., et al., Arctic Seabed Ice Gouging and Large Subgouge Deformations, Proceedings, International Symposium on Frontiers in Offshore Geotechnics, 2005, pp. 645-650.
Palmer, A.C., et al., Design and Installation of an Offshore Flowline for the Canadian Arctic Islands, Offshore Technology Conference, Apr. 30-May 3, 1979, pp. 765-772, Offshore Technology Conference., Houston, Texas, U.S.A.
Palmer, A.C., et al., Ice Gouging and the Safety of Marine Pipelines, Offshore Technology Conference, May 7-10, 1990, pp. 235-244, Offshore Technology Conference, Houston, Texas, U.S.A.
Palmer, A.C. et al., Ice Gouging and Pipelines: Unresolved Questions, pp. 1-8.
Woodworth-Lynas, Christopher, et al., Subgouge deformations and the security of Arctic marine pipelines, Offshore Technology Conference, May 6-9, 1996, pp. 657-664, Offshore Technology Conference, Houston, Texas, U.S.A.

* cited by examiner

*Primary Examiner* — David Bagnell
*Assistant Examiner* — Benjamin Fiorello
(74) *Attorney, Agent, or Firm* — Edmonds & Nolte, PC

(57) ABSTRACT

Systems and methods for protecting a subterranean structure. The method can include, but is not limited to, removing at least a portion of earth disposed above a subterranean structure to provide a foundation; depositing an isolation layer above the subterranean structure; and depositing at least a portion of the removed earth, a fill material or both to at least partially cover the isolation layer.

21 Claims, 1 Drawing Sheet

SYSTEMS AND METHODS FOR PROTECTING SUBTERRANEAN STRUCTURES

BACKGROUND

1. Field of the Invention

Embodiments described generally relate to systems and methods for protecting subterranean structures. More particularly, embodiments described relate to systems and methods for protecting subterranean structures against external stresses.

2. Description of the Related Art

Ice in the Arctic and sub-Arctic areas pose a substantial risk to underwater pipelines. As ice drifts into shallow waters, water currents, wind, and other masses of ice continue to push the ice into waters shallow enough that the ice gouges into the bottom of the body of water. Ice gouging has been observed in many parts of the world, as far south as the northern Caspian, Lake Erie, and offshore Sakhalin. The gouges can be large and deep with breadths more than 100 meters and depths more than 7 meters. The force exerted by the ice to create such large gouges can easily reach 100 MN. If this level of force were applied to a seabed structure, such as a pipeline or wellhead, substantial damage could occur.

Protection of underwater pipelines, wellheads, and other equipment from ice gouges is extremely difficult and usually economically impractical. Currently pipelines and other underwater structures are often buried at a depth of 1 to 2 meters to protect the structures against fishing gear, dragging anchors, hydrodynamic forces, and seabed level changes. However, those depths are insufficient to protect an underwater structure against the forces exerted on the floor bed of a body of water. Furthermore, burying an underwater pipeline, wellhead, or other structure to depths necessary to reduce or eliminate potential damage from ice gouging can be economically impractical or physically impossible, as such equipment does not exist for burying structures in waters much deeper than about 20 meters.

There is a need, therefore, for more efficient systems and methods for protecting subterranean structures.

SUMMARY OF THE INVENTION

Systems and methods for protecting a subterranean structure are provided. In at lest one specific embodiment, a method can include removing at least a portion of earth disposed above a subterranean structure to provide a foundation; depositing an isolation layer above the subterranean structure; and depositing at least a portion of the removed earth, a fill material or both to at least partially cover the isolation layer.

In at least one other specific embodiment, the method can include removing earth to provide a recess beneath the surface; depositing a subterranean structure within the recess; depositing an isolation layer above the subterranean structure; and depositing at least a portion of the removed earth, a fill material, or both above the isolation layer.

In at least one specific embodiment, the system for protecting a subterranean structure can include a subterranean structure disposed beneath the earth; one or more isolation layers disposed above the subterranean structure; and one or more layers of fill material disposed above the isolation layer.

BRIEF DESCRIPTION OF THE DRAWINGS

So that the manner in which the above recited features can be understood in detail, a more particular description, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with publicly available information and technology.

Figure 1:
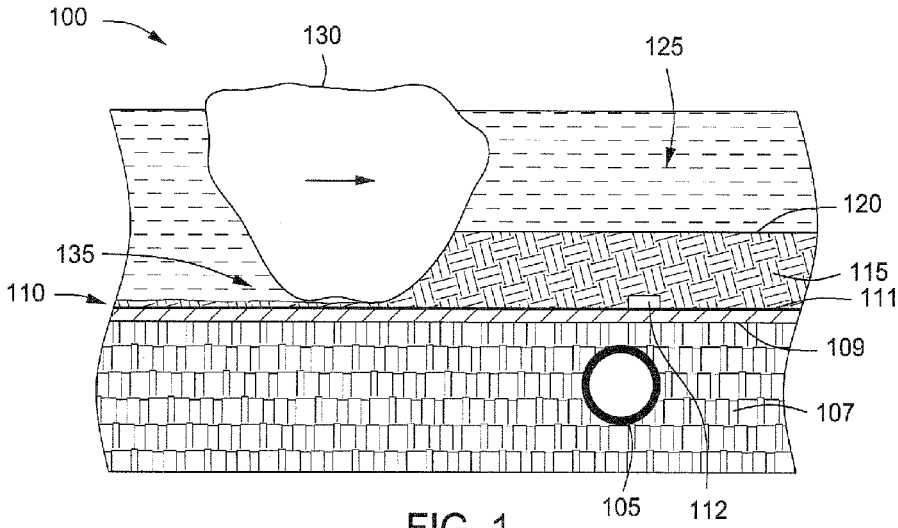
FIG. 1 depicts an illustrative system for protecting a subterranean structure, according to one or more embodiments described.

FIG. 1 depicts an illustrative system 100 for protecting a subterranean structure, according to one or more embodiments. In one or more embodiments, the system 100 can include one or more subterranean structures 105 (one is shown) disposed within the earth 107, one or more isolation layers 110 (one is shown), and one or more fill materials 115 (one is shown) disposed above the isolation layer 110. The isolation layer 10 can be deposited on a foundation 109 provided by removing at least a portion of the earth 107 disposed above the subterranean structure 105. The subterranean structure 105 can be disposed beneath the surface 120 of the fill material 115 at any suitable depth. The isolation layer 110 can be disposed between the subterranean structure 105 and the surface 120 of the fill material 115. As shown, the subterranean structure 105 is disposed beneath the floor of a body of water 125.

In one or more embodiments, the isolation layer 110 can isolate, reduce, or otherwise protect a subterranean structure from a force directed from the surface 120 toward the subterranean structure 105. Although not shown, the subterranean structure 105 can be at least partially housed within a caisson or any other protective structure.

In one or more embodiments, the force directed from the surface 120 can originate from one or more bodies 130 (one is shown) exerting force toward the subterranean structure 105. As the body 130 advances, the body 130 forms a gouge 135 into the surface 120 of the fill material 115. The body 130, which can continue to be urged forward (as shown, toward the right) by currents, wind, the body's own power, the body's own momentum, gravity, other bodies, or a combination thereof, can continue to form the gouge 135 along the surface 120. The formation of the gouge 135 by the body 130 exerts a force toward the subterranean structure 105, which can damage or otherwise affect the subterranean structure 105 in such a manner that can affect the structural integrity of the subterranean structure 105.

In one or more embodiments, the isolation layer 110 can protect the subterranean structure 105. The isolation layer 110 can absorb, deflect, or otherwise divert the force exerted by the body 130 toward the subterranean structure 105, thereby reducing and/or preventing damage to the subterranean structure 105. In one or more embodiments, the isolation layer 110 can include any material or combination of materials suitable for reducing, diverting, absorbing, and/or eliminating a force from the subterranean structure toward the body 130. In one or more embodiments, the isolation layer 110 can slide or otherwise move along with the body 130 as the gouge 135 is being formed in the fill material 115.

In one or more embodiments, the force exerted by the body 130 toward the subterranean structure 105 can range from about 0.1 MN to about 1,000 MN or more. For example, the force exerted by the body 130 toward the subterranean structure 105 can be greater than about 0.5 MN, greater than about 1 MN, greater than about 10 MN, greater than about 25 MN, greater than about 50 MN, greater than about 75 MN, greater than about 100 MN, greater than about 150 MN, greater than about 200 MN, greater than about 500 MN, or more. In one or more embodiments, the isolation layer 110 can absorb, deflect, or otherwise divert at least a portion of this large force exerted by the body 135 toward the subterranean structure 105, thereby preventing and/or reducing damage to the subterranean structure 105.

In one or more embodiments, the body 130 can form a gouge 135 having a depth of about 0.1 m or more, about 0.5 m or more, about 1 m or more, about 2 m or more, about 4 m or more, about 5 m or more, about 7 m or more, about 9 m or more, about 11 m or more, about 13 m or more, or about 15 m or more. In one or more embodiments, the gouge 135 can have a width ranging from a low of about 0.5 m, about 1 m, or about 5 m to a high of about 50 m, about 75 m, about 100 m, or more.

In one or more embodiments, the isolation layer 110 can be or include any suitable material or combination of materials. In one or more embodiments, the isolation layer 110 can include a plurality of layers. In one or more embodiments, the isolation layer 110 can include a plurality of layers that can be the same material. In one or more embodiments, the isolation layer 110 can include a plurality of layers that are different. In one or more embodiments, the isolation layer 110 can include a plurality of layers that alternate between two types of material. In one or more embodiments, the isolation layer 110 can include a plurality of layers that successively or non-successively alternate between two or more types of material. In one or more embodiments, earth 107 and/or fill material 115 can be disposed between successive isolation layers 110.

In one or more embodiments, the isolation layer 110 can extend beyond the perimeter of the subterranean structure 105. In one or more embodiments, the isolation layer 110 can extend beyond the perimeter of the subterranean structure 105 by about 0.5 m or more. For example the isolation layer 110 can extend beyond the perimeter of the subterranean structure 105 for a length ranging from a low of about 1, about 2.5 m, or about 5 m to a high of about 10 m, about 15 m, about 20 m, or more.

In one or more embodiments, the subterranean structure 105 can be disposed at any suitable depth beneath the surface 120 of the fill material 115. For example the earth 107 can be removed to a depth of about 3 m, about 5 m, about 7.5 m, about 10 m, or more and the subterranean structure 105 can then be deposited within the recess formed by removing the earth 107. In one or more embodiments, the isolation layer 110 can be deposited immediately above the subterranean structure 105. In one or more embodiments, a portion of the removed earth 107 and/or fill material 115 can be disposed on top of the subterranean structure 105 prior to disposing the isolation layer 110 above the subterranean structure 105. In one or more embodiments, the removed earth and/or fill material can be deposited above the subterranean structure 105 to a depth ranging from about 0.1 m, about 0.5 m, about 1 m, about 2 m, about 4 m, or more prior to depositing the isolation layer 110 above the subterranean structure 105.

In one or more embodiments, the isolation layer 110 can be any suitable thickness. In one or more embodiments, the thickness of the isolation layer 110 can range from a low of about 0.1 m, about 0.3 m, about 0.5 m, about 0.8 m, or about 1 m to a high of about 2 m, about 3 m, about 4 m, about 5 m, or more. In one or more embodiments, the thickness of the isolation layer 110 can range from about 0.5 m to about 1 m, about 0.75 m to about 2 m, about 1.5 m to about 3 m, about 2 m to about 5 m, or about 0.5 m to about 5 m.

In one or more embodiments, the earth 107 can be removed using any suitable device, system, or combination of systems and/or devices. For example, the earth can be removed using shovels, backhoes, cranes, dredges, explosive charges, jack hammers, plows, rotary cutting tools, trenching machines, and the like. In one or more embodiments, the earth can be removed using one or more jets of a compressed fluid, for example water. For a subterranean structure 105 disposed under the floor of a body of water silt or soil vacuum removal system can be used to remove the earth.

In one or more embodiments, the isolation layer 110 can include a soft soil mixed with water. The mixture of the soft soil and water can provide an isolation layer 110 having reduced shear strength. Illustrative soft soils can include, but are not limited to clay, mud, peat, silt, or any combination thereof. The water content of the mixture of the soft soil and water can range from a low of about 1% wt, about 5% wt, or about 10% wt to a high of about 100% wt, about 150%, about 200% wt, or more. As discussed and described herein, the water content of a mixture of soft soil and water is referred to as the weight of the water divided by the weight of the soil. The shear strength of the soft soil and water mixture can be reduced to a low level, but not so low that the isolation layer 110 cannot support the weight of the fill material 115 deposited above the isolation layer 110.

In one or more embodiments, the isolation layer 110 can include a mixture of water and a portion of the earth removed during installation of the subterranean structure 105. Mixing the earth removed during installation of the subterranean structure 105 can eliminate the need to import other fill materials from off-site locations, which can reduce the cost and time required for installing and isolating the subterranean structure. The water content of the mixture of removed earth and water can range from a low of about 1% wt, about 5% wt, or about 10% wt to a high of about 100% wt, about 150% wt, about 200% wt, or more. The shear strength of the removed earth and water mixture can be reduced to a low level, but not so low that the isolation layer 110 cannot support the weight of the fill material 115 deposited above the isolation layer 110.

In one or more embodiments, the isolation layer 110 can include a soft soil, a portion of the earth removed during installation of the subterranean structure, or both with water and one or more plasticizing agents. The one or more plasticizing agents can modify the plasticity, fluidity, and/or shear strength of the isolation layer 110. Improving the plasticity of the isolation layer 110 can improve the installation of the isolation layer 110. In one or more embodiments, the content of water in the mixture of removed earth, water, and one or more plasticizing agents can range from a low of about 1% wt, about 5% wt, or about 10% wt to a high of about 100% wt, about 150%, about 200% wt, or more. In one or more embodiments, the content of the one or more plasticizing agents in the mixture of removed earth, water, and one or more plasticizing agents can range from a low of about 0.1% wt, about 1% wt, or about 3% wt to a high of about 10% wt, about 12% wt, about 15% wt, or more. The shear strength of the removed earth and water mixture can be reduced to a low level, but not so low that the isolation layer 110 cannot support the weight of the fill material 115 deposited above the isolation layer 110.

In one or more embodiments, the isolation layer 110 can include one or more plastic sheets (one is shown, 111). The one or more plastic sheets 111 can be or include any suitable plastics. Illustrative plastics, can include, but are not limited to, polyethylenes, polyflurorethylenes, polypropylenes, polytetrafluroethylenes, vinyl ester resin, polyvinyl chloride (PVC), isophthalic polyester resin, phenolic, neoprenes, or any combination thereof. The one or more plastic sheets 111 can be of suitable strength for supporting the fill material 115 deposited above.

In one or more embodiments, the one or more plastic sheets 111 can have any suitable thickness. In one or more embodiments, the one or more plastic sheets 111 can have a thickness ranging from about 1 mm to about 5 m, about 5 cm to about 1 m, about 50 cm to about 1.5 m, about 1 m to about 3 m, for example. In one or more embodiments, the one or more plastic sheets 111 can have a thickness ranging from a low of about 0.5 mm, about 1 mm, or about 2 mm to a high of about 5 mm, about 10 mm, about 20 mm, or more. In one or more embodiments, the one or more plastic sheets 111 can have a thickness ranging from a low of about 0.5 cm, about 1 cm, or about 2 cm to a high of about 3 cm, about 10 cm, about 25 cm, or more.

In one or more embodiments, the one or more plastic sheets 111 can include one or more weights (one is shown, 112) disposed in, on, and/or about the plastic sheets 111. The one or more weights 112 can provide a neutrally buoyant or negatively buoyant plastic sheet 111. In one or more embodiments, the weights 112 can include, but are not limited to rocks, metal, concrete, soil, sand, and the like.

In one or more embodiments, the one or more plastic sheets can be coated with one or more lubricants. The lubricant can remain stable over the expected operating life of the isolation layer 110. The lubricant can be an environmentally stable or otherwise environmentally harmless. The lubricant can be biodegradable or non-biodegradable. In one or more embodiments, the lubricant can include, but is not limited to, greases, liquid hydrocarbons, vegetable oils, liquid soaps, powders, or any combination thereof. Illustrative liquid hydrocarbons can include any suitable hydrocarbon, for example mineral oils and/or motor oils. Illustrative greases can include silicone, fluoropolymers, Vaseline, sodium based greases, barium based greases, lithium based greases, calcium based greases, or combinations thereof. Illustrative powders can include graphite, polytetrafluoroethylene, molybdenum disulfide, tungsten disulfide, or combinations thereof. Illustrative liquid soaps can include dishwashing detergents and/or hand soaps.

In one or more embodiments, the isolation layer 110 can include one or more geotextiles. The one or more geotextiles can be made from polypropylene or polyester, for example. The one or more geotextiles can be woven, needle punched, heat bonded, or any combination thereof. The one or more geotextiles can reinforce the soil below the geotextile, once installed, thereby reducing or eliminating deformation of the soil around the subterranean structure. In one or more embodiments, the one or more geotextiles can have a slippery surface, or in other words a low coefficient of friction. In one or more embodiments, the one or more geotextiles can have a coefficient of friction less than about 1. In one or more embodiments, the one or more geotextiles can have a coefficient of friction of about 0.001, about 0.01, about 0.1, about 0.2, about 0.3, about 0.5, or more. The one or more geotextiles can be of sufficient strength to support the earth and/or other fill material 115 deposited above.

In one or more embodiments, the fill material 115 can include any material suitable for disposing above the isolation layer 110. Illustrative fill materials 115 can include, but are not limited to the removed earth, rocks, sand, gravel, clay, pebbles, dirt, soil, concrete, crushed concrete, shell, or any other material suitable for filling in at least a portion of the recess between the isolation layer 110 and the surface of the earth.

The subterranean structure 105 as illustrated is a pipeline; however the subterranean structure 105 can be any suitable structure. In one or more embodiments, the one or more subterranean structures 105 can include, but are not limited to pipelines, hydrocarbon production equipment, communication lines, electrical lines, tunnels, storage facilities, or any combination thereof. In one or more embodiments, the pipelines can transports oil, gas, chemicals, water, any other flowable materials, or any combination thereof. In one or more embodiments, the hydrocarbon production equipment can include well heads, pumps, well bore connection equipment, and any other hydrocarbon production equipment disposed sub-surface. In one or more embodiments, the communication lines can include audio lines, video lines, telegraph lines, fiber optic lines, internet lines, any other data transmission lines, or any combination thereof. In one or more embodiments, the electrical lines can include electric power transmission lines. In one or more embodiments, the tunnels can include mining shafts, transportation tunnels such as automobile, railway, and/or pedestrian tunnels, utility tunnels, aqueducts, or any combination thereof. In one or more embodiments, the storage facilities can store hydrocarbons, chemicals, food, water, or any other storable material.

The body 130 as illustrated is a body of ice or an iceberg; however the body 130 can be any body capable of exerting force on the surface 120. Illustrative bodies 130 can include, but are not limited to icebergs, floating vessels, glaciers, semi-submersible vessels, submersible vessels, anchors, fishing equipment, dredging equipment, or any combination thereof. Illustrative floating vessels can include, but are not limited to ships, tanker ships, cruise ships, barges, boats, sail boats, crane vessels, aircraft carriers, container ships, and general cargo ships. Illustrative semi-submersible vessels can include, but are not limited to, semi-submersible heavy lift ships, offshore drilling rigs, semi-submersible dry docks, and semi-submersible crane vessels. Illustrative submersible vessels can include, but are not limited to submarines. Other bodies 125 can include, for example, glaciers or an avalanche or other moving mass down a sloped surface, such as a mountain side.

Figure 2:
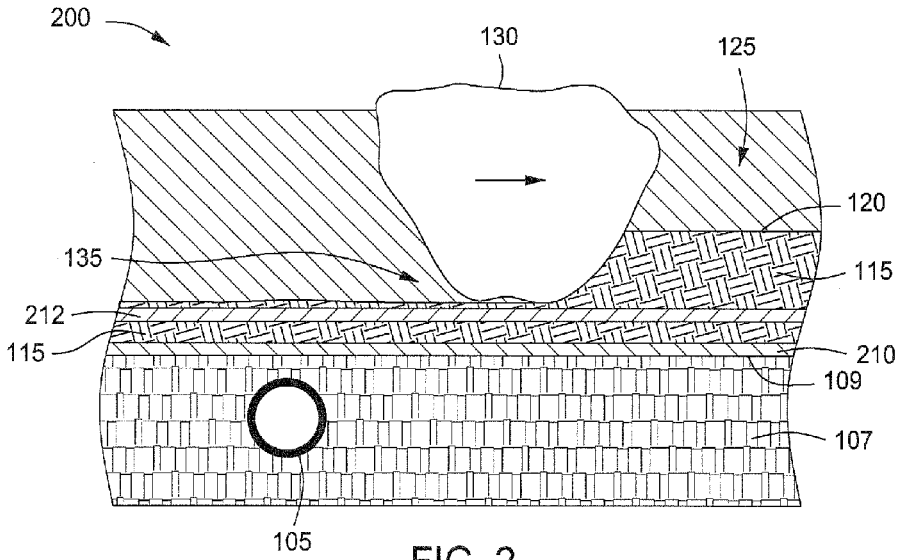
FIG. 2 depicts another illustrative system for protecting a subterranean structure, according to one or more embodiments described.

FIG. 2, depicts another illustrative system 200 for protecting a subterranean structure, according to one or more embodiments. In one or more embodiments, the system 100 can include one or more subterranean structures 105 (one is shown), and one or more isolation layers 210, 212 (two are shown), and one or more fill materials 115 (one is shown) disposed above the isolation layer 110. The subterranean structure 105, fill material 115, and bodies 130 can be as discussed and described above with reference to FIG. 1. The two isolation layers 210, 212 and the fill material 215 can be similar to the isolation layer 110 and the fill material 115 discussed and described above with reference to FIG. 1.

As shown, the isolation layers 210, 212 include fill material 215 disposed therebetween. The isolation layer 210 can be deposited on a foundation 109 provided by removing at least a portion of the earth 107 disposed above the subterranean structure 105. In one or more embodiments, the isolation layers 210, 212 can isolate, reduce, or otherwise protect a subterranean structure from a force directed from one or more bodies 130 the surface 120 toward the subterranean structure 105. Although not shown, the subterranean structure 105 can be at least partially housed within a caisson or any other protective structure.

FIG. 2 depicts the subterranean structure 105 after the body 130 has formed a gouge 135 through the fill material 115 deposited above the subterranean structure 105. As illustrated, the subterranean structure 105 remained undamaged because the isolation layers 210, 212 absorbed, deflected, or otherwise diverted the force exerted by the body 130 toward the subterranean structure 105.

In one or more embodiments, the height of the fill material deposited between the isolation layers 210, 212 can be any suitable height. In one or more embodiments, the height of the fill material 215 deposited between the isolation layers 210, 212 can range from a low of about 0.1 m, about 0.2 m, or about 0.3 m to a high of about 0.5 m, about 1 m, about 2 m or more. In one or more embodiments, the height of the fill material 215 deposited between the isolation layers 210, 212 can range from about 0.25 m to about 5 m, about 0.1 m to about 2 m, about 0.2 m to about 2.5 m, about 0.5 m to about 1 m, or about 0.5 m to about 1.5 m.

Referring to both FIGS. 1 and 2, the shift or movement of the subterranean structure 105 due to the force exerted by the body 130 can be none or minimal. In one or more embodiments, the subterranean structure 105 can move less than about 10 m, less than about 5 m, less than about 3 m, less than about 1 m, less than about 0.5 m, less than about 0.1 m, or less. In one or more embodiments, the subterranean structure 105 can experience no movement from the force exerted by the body 130. In one or more embodiments, the subterranean structure can experience minimal vibration or no vibration. In one or more embodiments, the effect of the body 130 forming the gouge 135 in the fill material 115 can result in either no damage or inconsequential damage to the subterranean structure 105.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for protecting a subterranean structure, comprising:

removing at least a portion of earth disposed above a subterranean structure to provide a foundation;

mixing water with the removed earth in an amount sufficient to provide a dirt mixture having a reduced shear strength compared to the removed earth alone;

depositing a plastic sheet coated with a lubricant and the dirt mixture having the reduced shear strength on the foundation to provide an isolation layer; and depositing any remaining removed earth, fill material, or both to at least partially cover the isolation layer.

2. The method of claim 1, wherein the subterranean structure is disposed beneath a body of water.

3. The method of claim 1, wherein the plastic sheet comprises polyethylene, neoprene, or a combination thereof.

4. The method of claim 1, wherein the isolation layer extends at least one meter from a perimeter of the subterranean structure.

5. The method of claim 1, wherein the subterranean structure comprises a pipeline, a hydrocarbon production equipment, a communication line, an electrical line, tunnels, storage facilities, or any combination thereof.

6. The method of claim 5, wherein the pipeline transports oil, gas, chemicals, water, or a combination thereof.

7. The method of claim 5, wherein the communication line comprises a telephone line, an internet line, video line, a fiber optic line, or any combination thereof.

8. The method of claim 1, wherein the dirt mixture further comprises a softer soil.

9. The method of claim 8, wherein the softer soil is mud.

10. The method of claim 8, wherein the softer soil comprises clay, peat, silt, or any combination thereof.

11. The method of claim 1, wherein the isolation layer comprises a plurality of discrete layers.

12. The method of claim 1, wherein the fill material is present, and comprises concrete, crushed concrete, or shell.

13. The method of claim 1, wherein the lubricant comprises greases, liquid hydrocarbons, vegetable oils, liquid soaps, powders, or any combination thereof.

14. The method of claim 1, wherein the subterranean structure is disposed beneath a body of water and one or more weights are used in the plastic sheet, on the plastic sheet, about the plastic sheet, or a combination thereof to cause the plastic sheet to be neutrally buoyant or negatively buoyant within the body of water.

15. A method for protecting a subterranean structure, comprising:

removing earth to provide a recess beneath the surface;

depositing a subterranean structure within the recess;

depositing a dirt mixture comprising a softer soil, the removed earth, and water to provide an isolation layer, wherein the water is present in the dirt mixture in an amount sufficient to reduce the shear strength of the dirt mixture compared to the removed earth alone, wherein the softer soil is mud; and depositing any remaining removed earth, fill material, or both above the isolation layer.

16. The method of claim 15, further comprising disposing at least a portion of the removed earth, the fill material, or both above the subterranean structure before disposing the isolation layer above the subterranean structure.

17. The method of claim 15, wherein the subterranean structure is disposed beneath a body of water.

18. The method of claim 15, wherein the subterranean structure comprises a pipeline, a hydrocarbon production equipment, a communication line, an electrical line, tunnels, storage facilities, or any combination thereof.

19. The method of claim 15, wherein the isolation layer extends at least one meter from the perimeter of the subterranean structure.

20. The method of claim 15, wherein the isolation layer comprises a plurality of layers.

21. The method of claim 15, wherein the isolation layer comprises a plurality of layers and wherein the layers are different.

* * * * *